US006454126B1

(12) United States Patent
Battegazzore

(10) Patent No.: US 6,454,126 B1
(45) Date of Patent: Sep. 24, 2002

(54) ANTI-FRAUD CLOSURE DEVICE

(75) Inventor: Piero Battegazzore, Alessandria (IT)

(73) Assignee: Guala Closures S.p.A., Alessandria (IT)

( * ) Notice: Subject to any disclaimer, the term of this patent is extended or adjusted under 35 U.S.C. 154(b) by 0 days.

(21) Appl. No.: 09/744,738

(22) PCT Filed: Jul. 19, 1999

(86) PCT No.: PCT/EP99/05127

§ 371 (c)(1),
(2), (4) Date: Apr. 2, 2001

(87) PCT Pub. No.: WO00/06461

PCT Pub. Date: Feb. 10, 2000

(30) Foreign Application Priority Data

Jul. 28, 1998 (EP) ..... 98830457

(51) Int. Cl.[7] ..... B67D 5/06

(52) U.S. Cl. ..... 222/23; 222/529; 222/530; 215/230; 215/308

(58) Field of Search ..... 222/23, 529, 530; 215/230, 308

(56) References Cited

U.S. PATENT DOCUMENTS

| | | | | | |
|---|---|---|---|---|---|
| 4,767,016 | A | * | 8/1988 | Cook | 215/230 |
| 5,417,860 | A | * | 5/1995 | Kay | 210/472 |
| 5,662,233 | A | * | 9/1997 | Reid | 215/273 |
| 5,909,845 | A | * | 6/1999 | Greatbatch | 239/44 |

* cited by examiner

*Primary Examiner*—Lesley D. Morris
*Assistant Examiner*—Melvin A. Cartagena
(74) *Attorney, Agent, or Firm*—Sofer & Haroun, LLP

(57) ABSTRACT

An anti-fraud closure device for providing evidence of the initial opening of a container for liquids having a pouring body, a connecting element, a mixing element for connecting the pouring body to the neck of the container, a removable cap and an outer cap disposed over and housing a cap. The device further includes a sleeve, a tubular element inserted in the sleeve and connected thereto for partial angular movement and for axial movement between a first and a second position and an element for indicating that the initial opening of the container has taken place.

19 Claims, 19 Drawing Sheets

ANTI-FRAUD CLOSURE DEVICE

Figure 1:
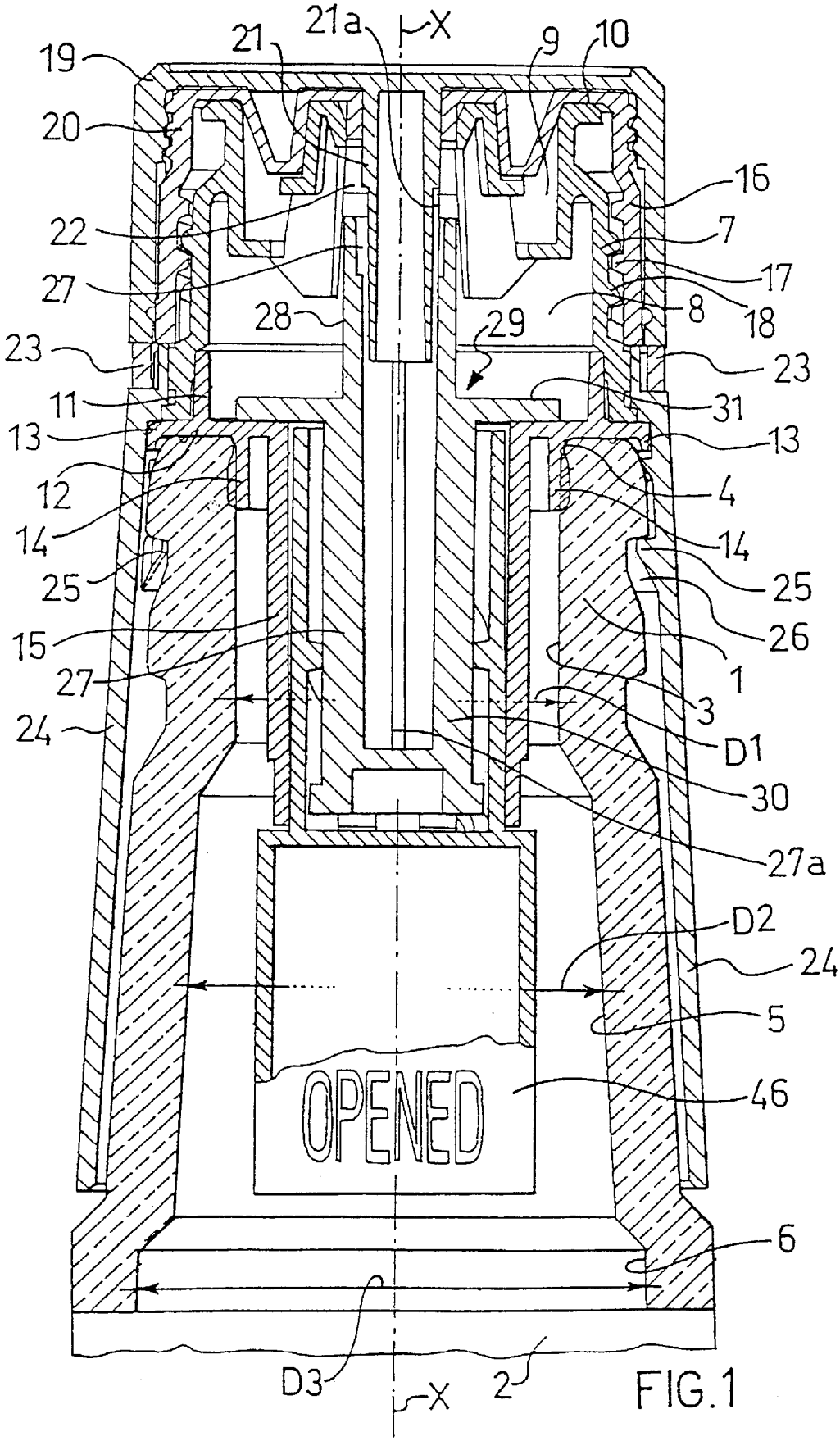

The present invention relates to an anti-fraud closure device for providing evidence of the initial opening of a container for liquids having an opening disposed at the end of a neck extending along a longitudinal axis and a duct inside the neck having at least one portion with a diameter larger than that of the portion immediately adjacent the opening, the closure device comprising a pouring body which has an internal axial cavity and which is positioned in the opening and projects axially outwards therefrom with a pouring hole, a connecting element which is free to move axially in the cavity of the pouring body, fixing means for connecting the pouring body to the neck of the container, and a removable cap on the pouring body for closing and opening the pouring hole, an outer cap disposed over and housing the cap, an axial stem carried by the outer cap and facing towards the pouring body, an axial duct in the pouring body, and an axial hole in the connecting element for housing the stem axially when the cap and the outer cap are positioned axially on the pouring body in order to close the hole.

As is known, there is a considerable risk that containers, particularly glass bottles for good-quality alcoholic beverages, may be recycled illegally after the original contents have been used up.

In fact, the original caps are removed from the empty containers and the containers are filled with poor-quality products which are thus passed off as the originals since the container is in fact the original container.

Although the re-capping is performed with caps which are also counterfeit, the fraud is difficult for a normal purchaser to detect because the container, which is the predominant and most easily recognizable element of the packaging, is actually the original container.

To try to eliminate or at least reduce the fraudulent use of containers in the above-mentioned manner, a system has been devised for causing a solid body, for example, made of metal or glass, which was originally engaged on one of the elements constituting the closure, to fall into the container when it is opened for the first time; since this body remains visible and cannot be removed through the neck of the container without the container or some components of the closure disposed in the neck being broken, it prevents the container from being re-used and passed off as original.

An example of this known technique is described in published French patent No. 2738802.

A known technique of another type directed towards preventing the re-use of containers provides for an indicator body connected to one of the elements of the closure to appear inside the container in the vicinity of the closure. This indicator body is normally in a bent position so as not to be visible and is pivoted to a visible position when the container is used for the first time.

An example of this known technique is described in published French patent No. 2739360.

Although both of the above-mentioned known techniques are theoretically effective for preventing fraudulent use of a container, they have the disadvantage that the bodies for providing evidence that the initial opening of the container has taken place are restrained on the closure by engagement means from which these bodies may be detached accidentally before the container is opened, making a container appear to have been already opened when it is still in its original state. Moreover, in both of the above-mentioned known techniques, the devices for indicating that the initial opening has taken place are activated by operations which provide for the removal of the outer metal sealing capsule and the movement of the cap in the opposite direction to the direction of opening.

The object of the present invention is to prevent the problems complained of with reference to the known techniques and to provide for an automatic indication of the fact that the initial opening of the container has taken place, immediately upon the initial opening, by means of the same movement which opens the cap and, at the same time, to ensure that the indication does not take place accidentally but only by means of a positive operation.

Another object of the invention is that of ensuring that the device providing evidence that the initial opening of the container has taken place is visible from all sides of the container as well as in all operative positions thereof.

This object is achieved by a device according to claim 1 below.

Figure 2:
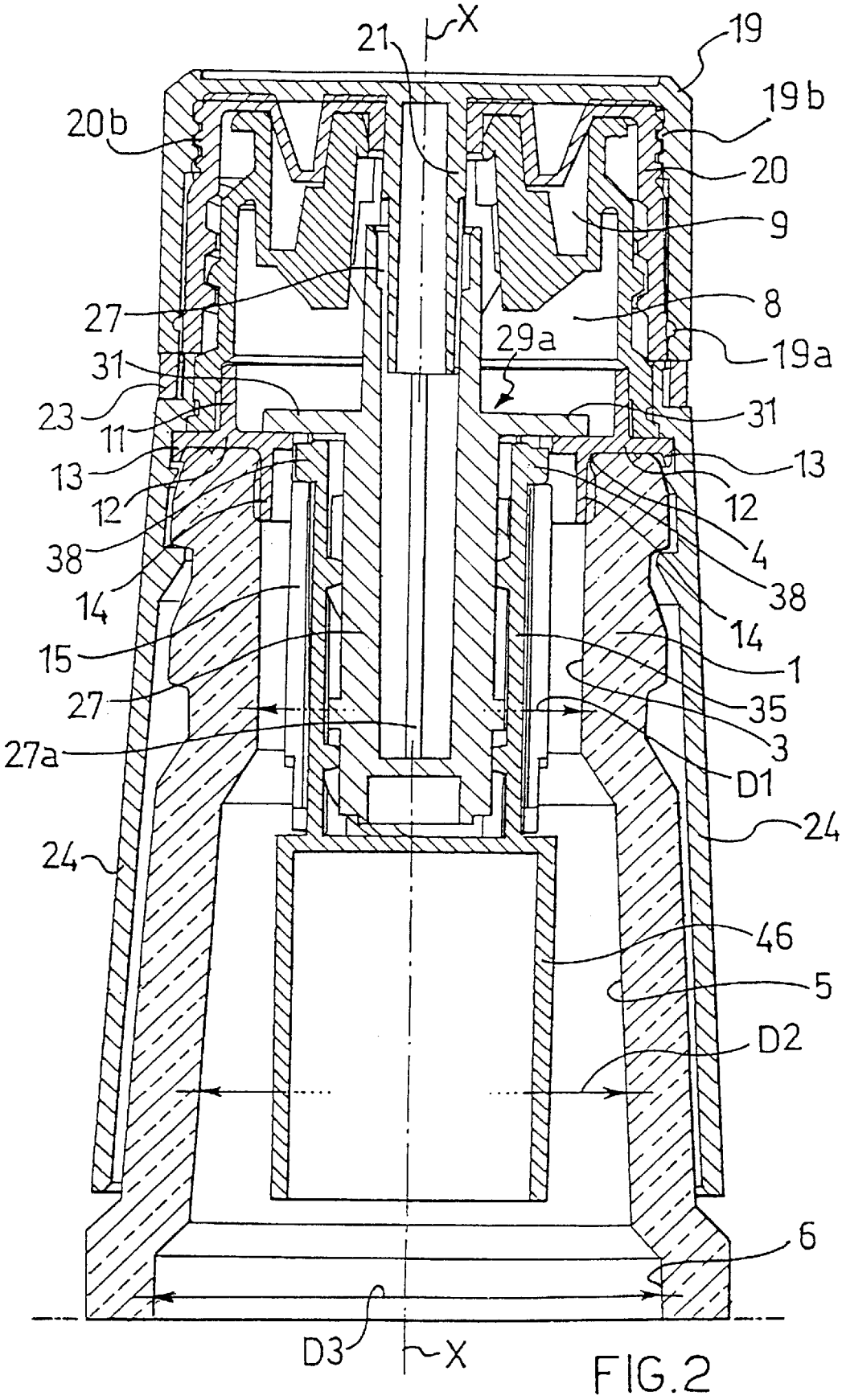
Figure 3:
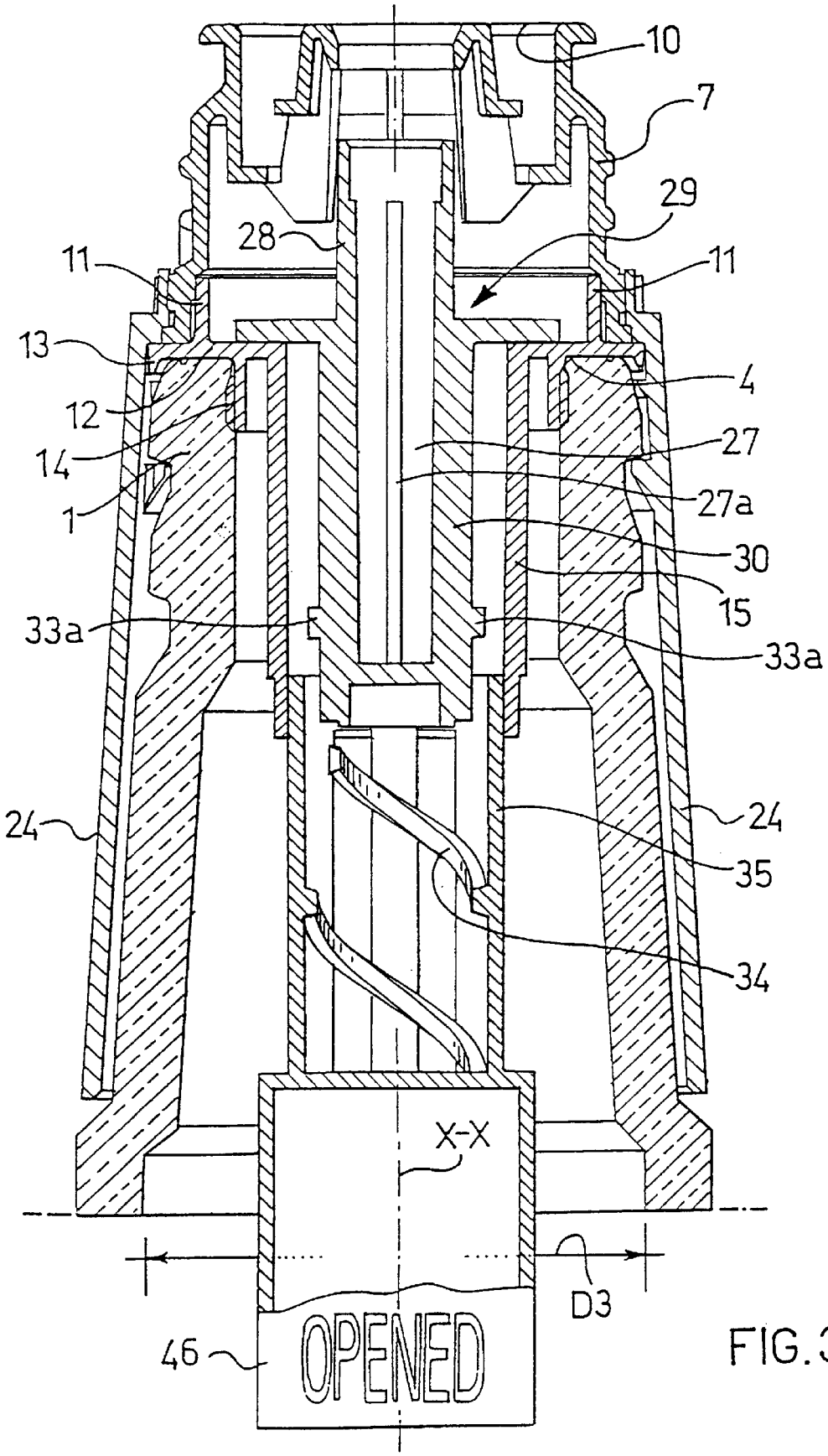
Figure 4:
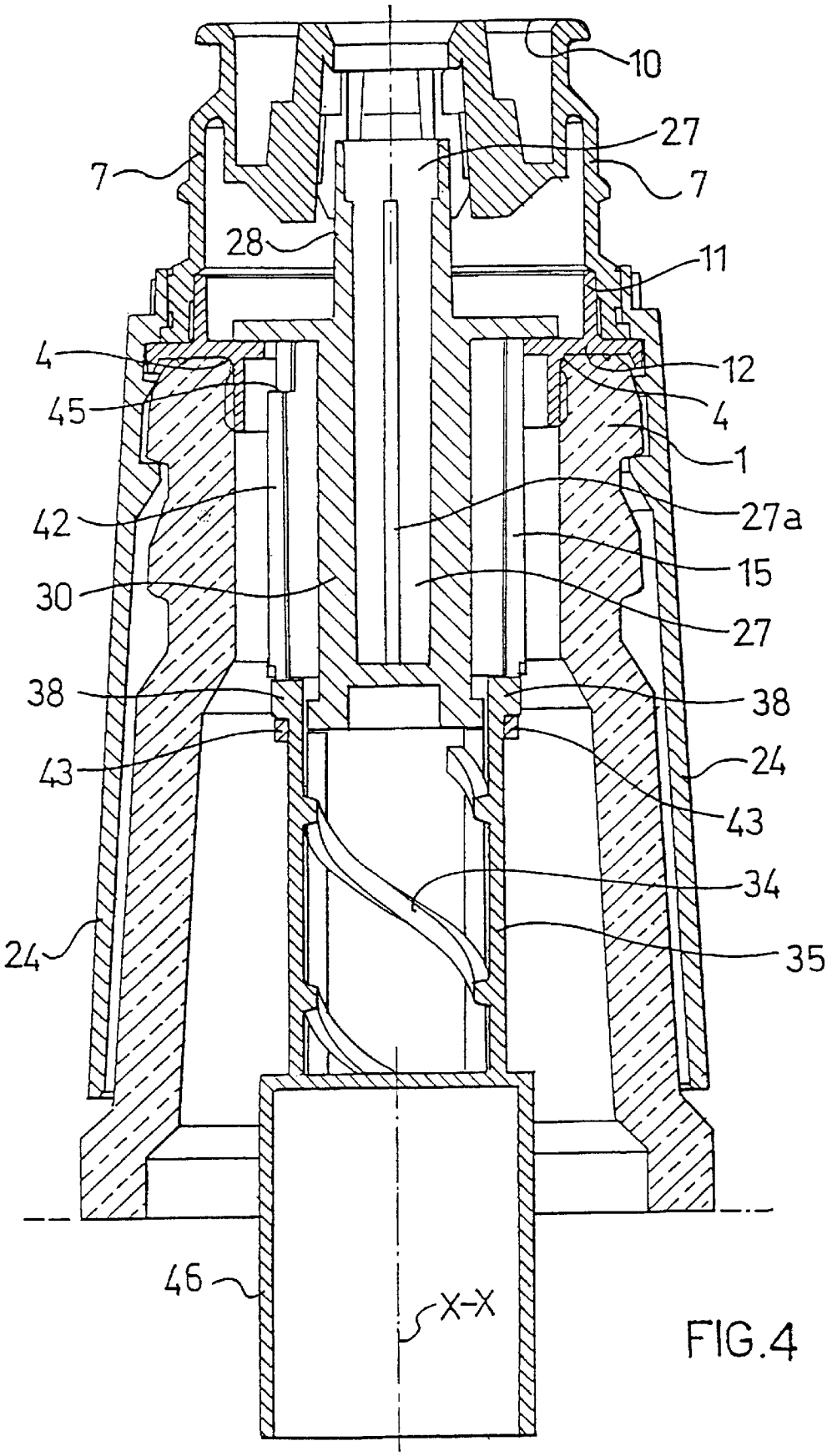
Figure 5:
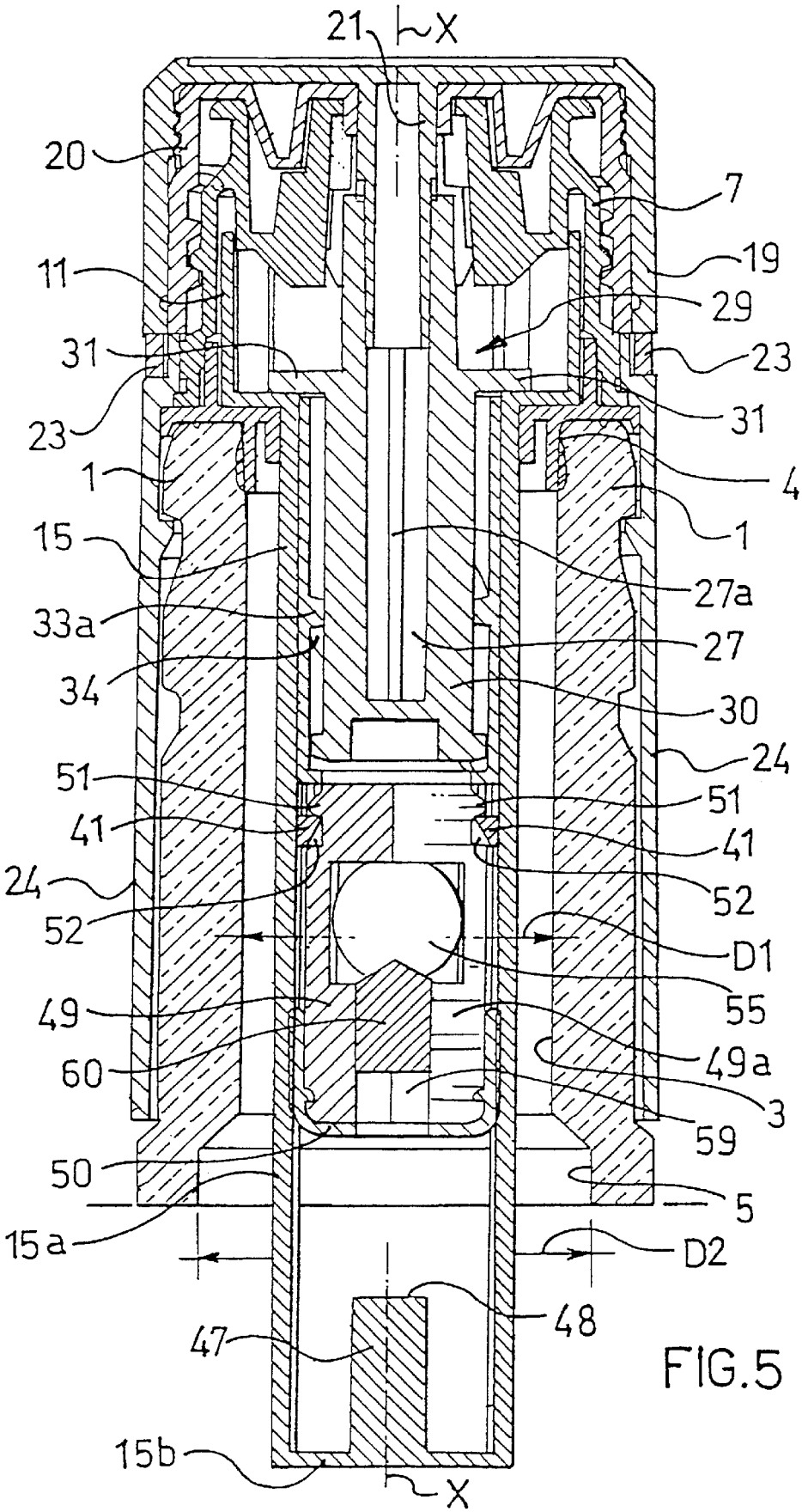
Figure 6:
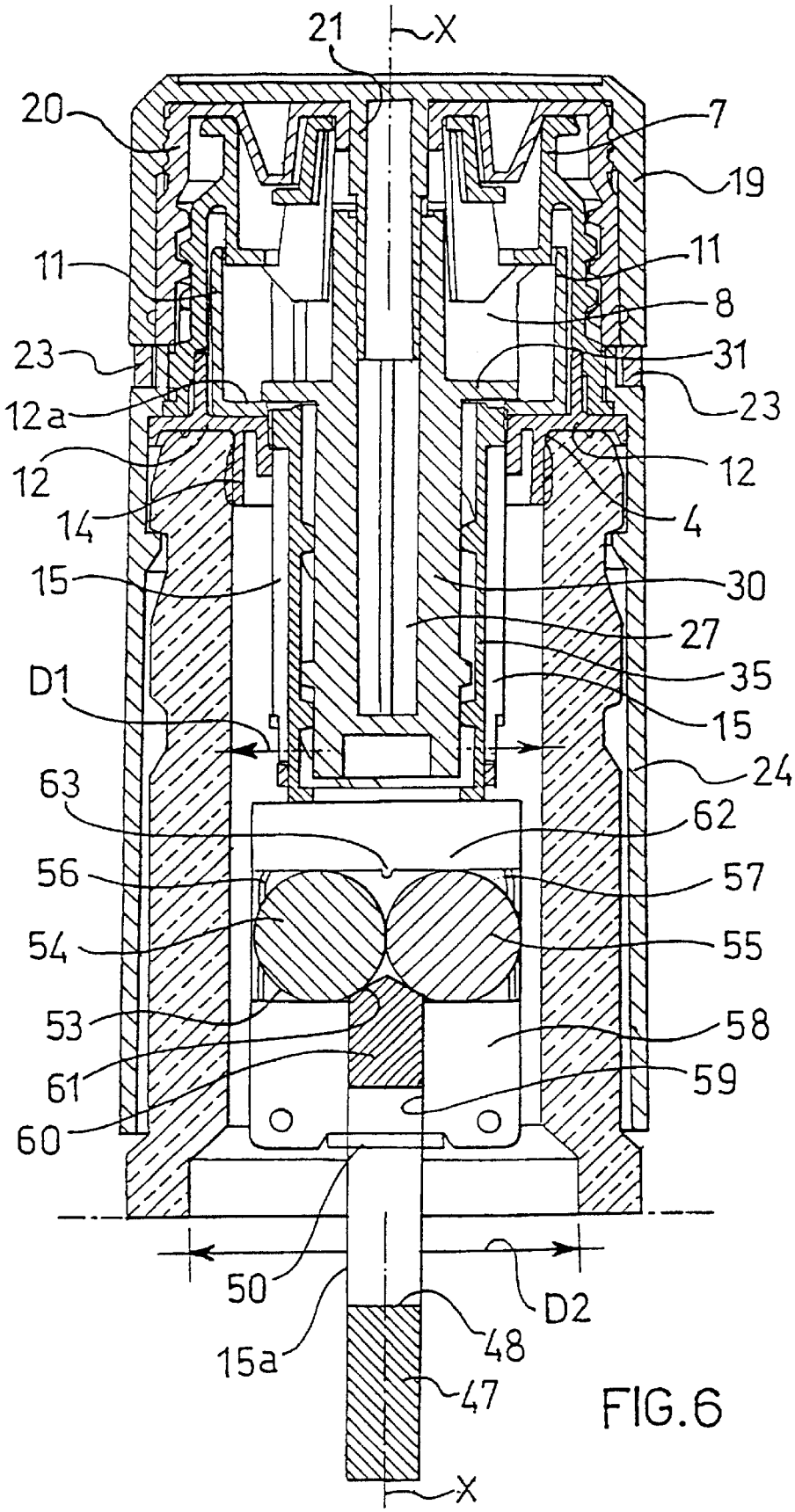
Figure 7:
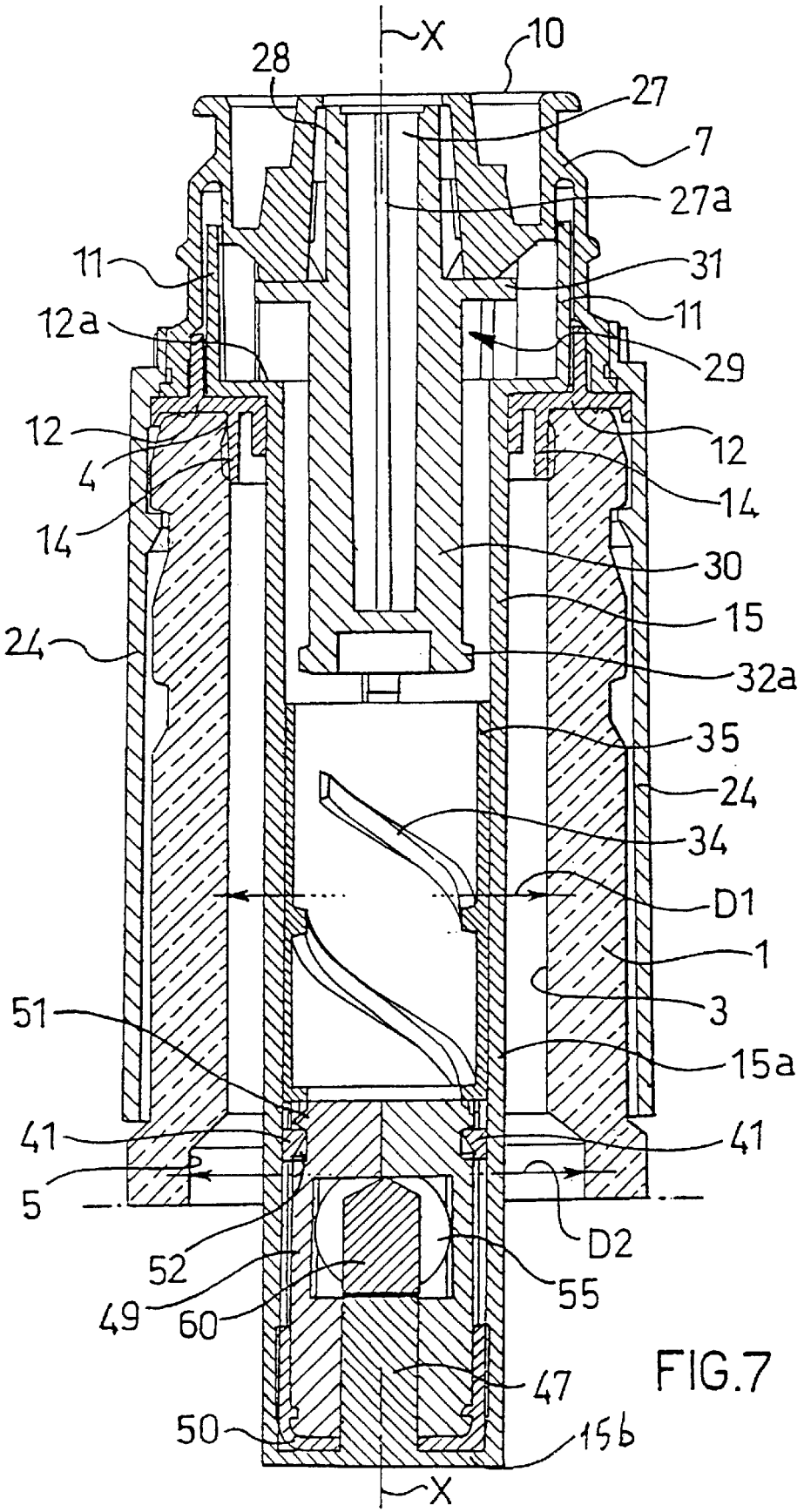
Figure 8:
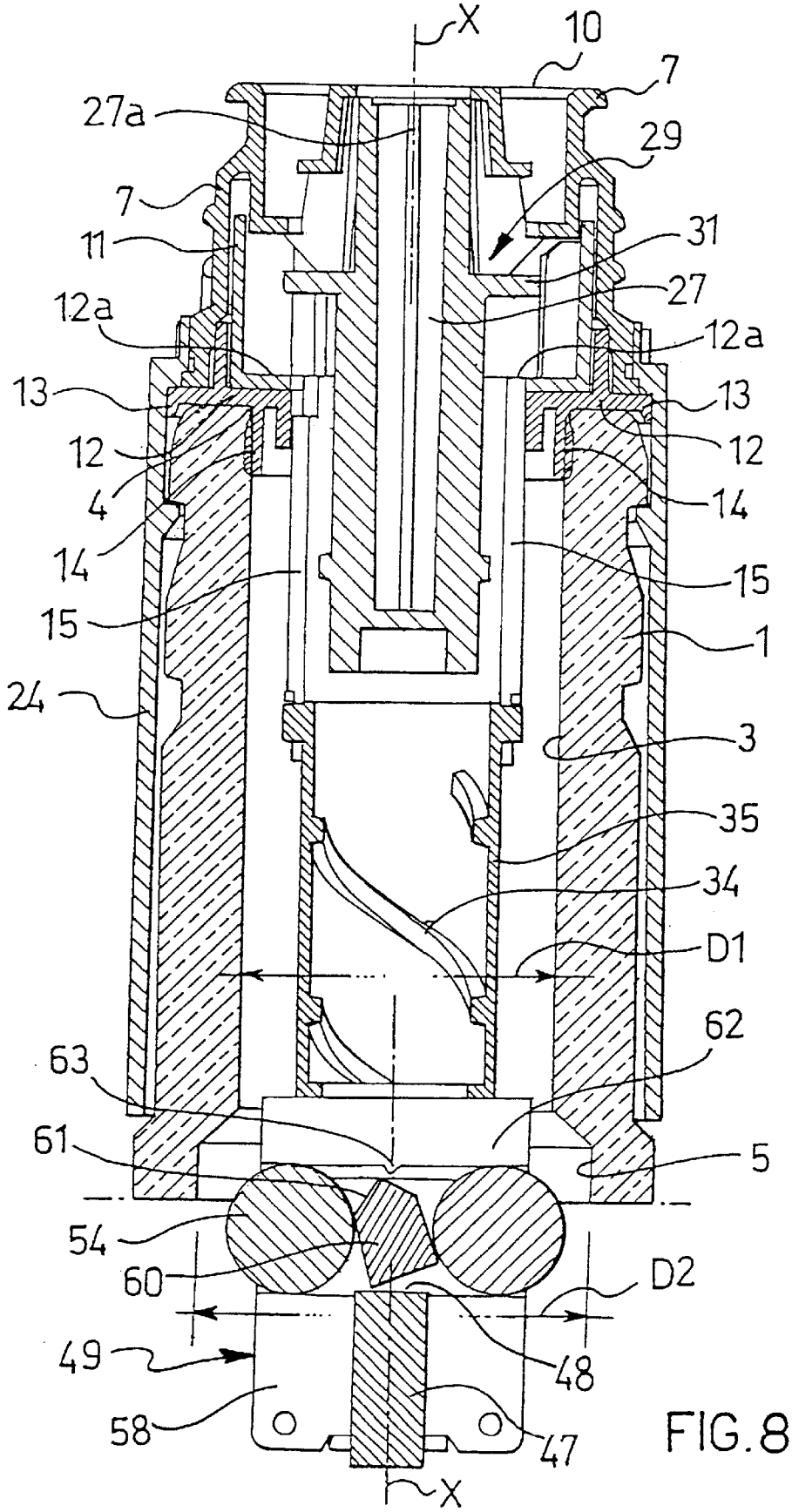
Figure 9:
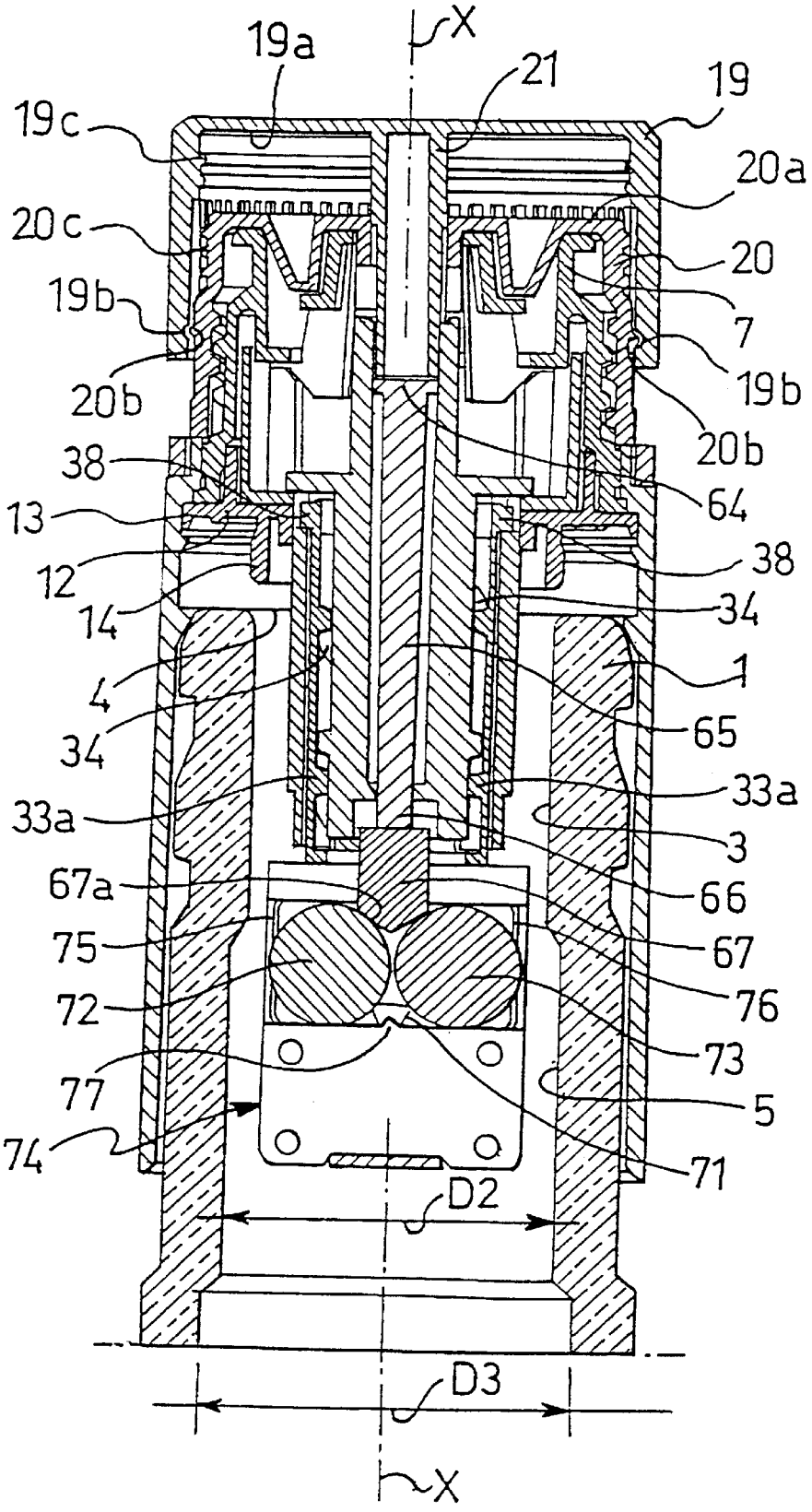
Figure 10:
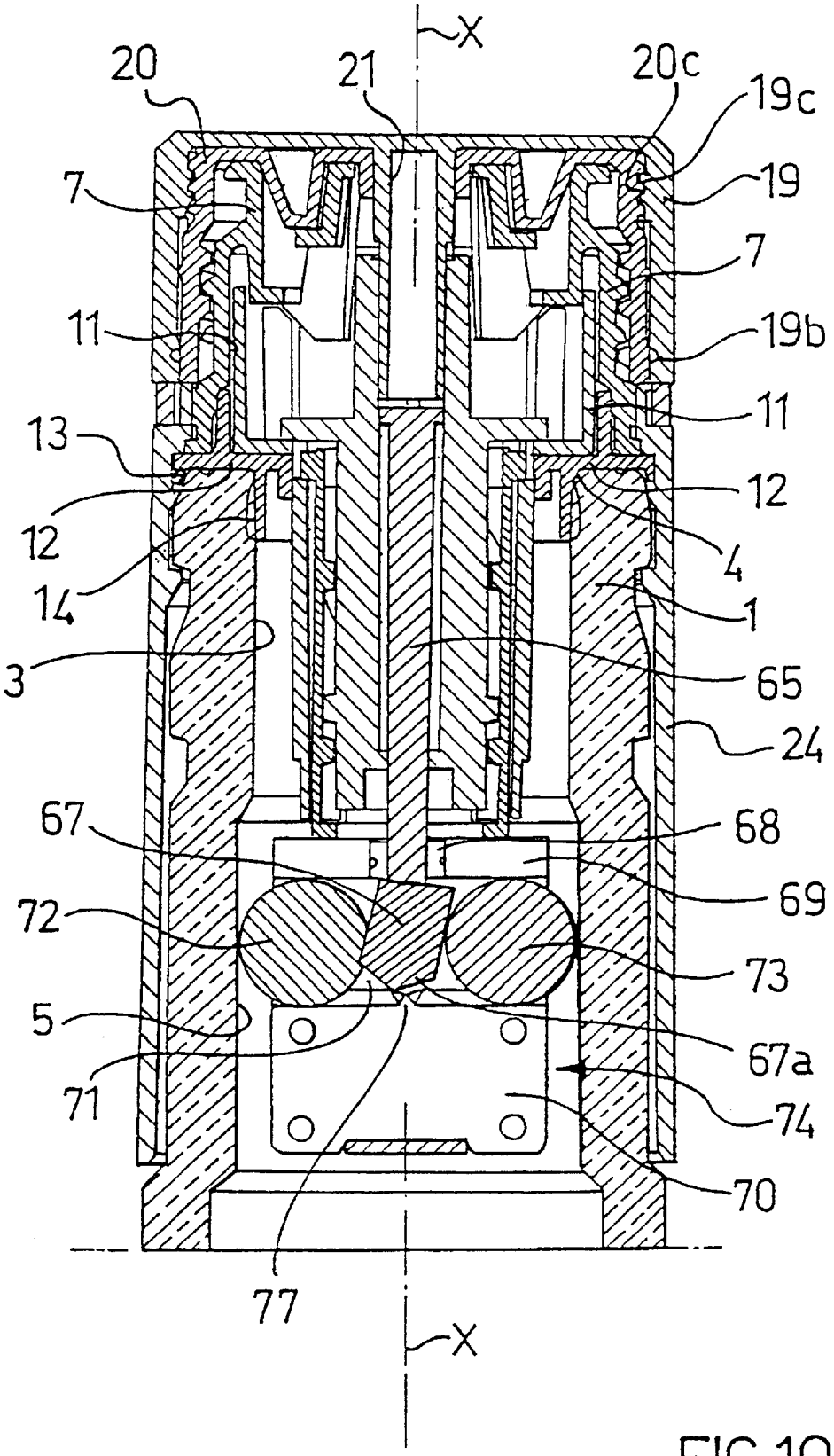
Figure 11:
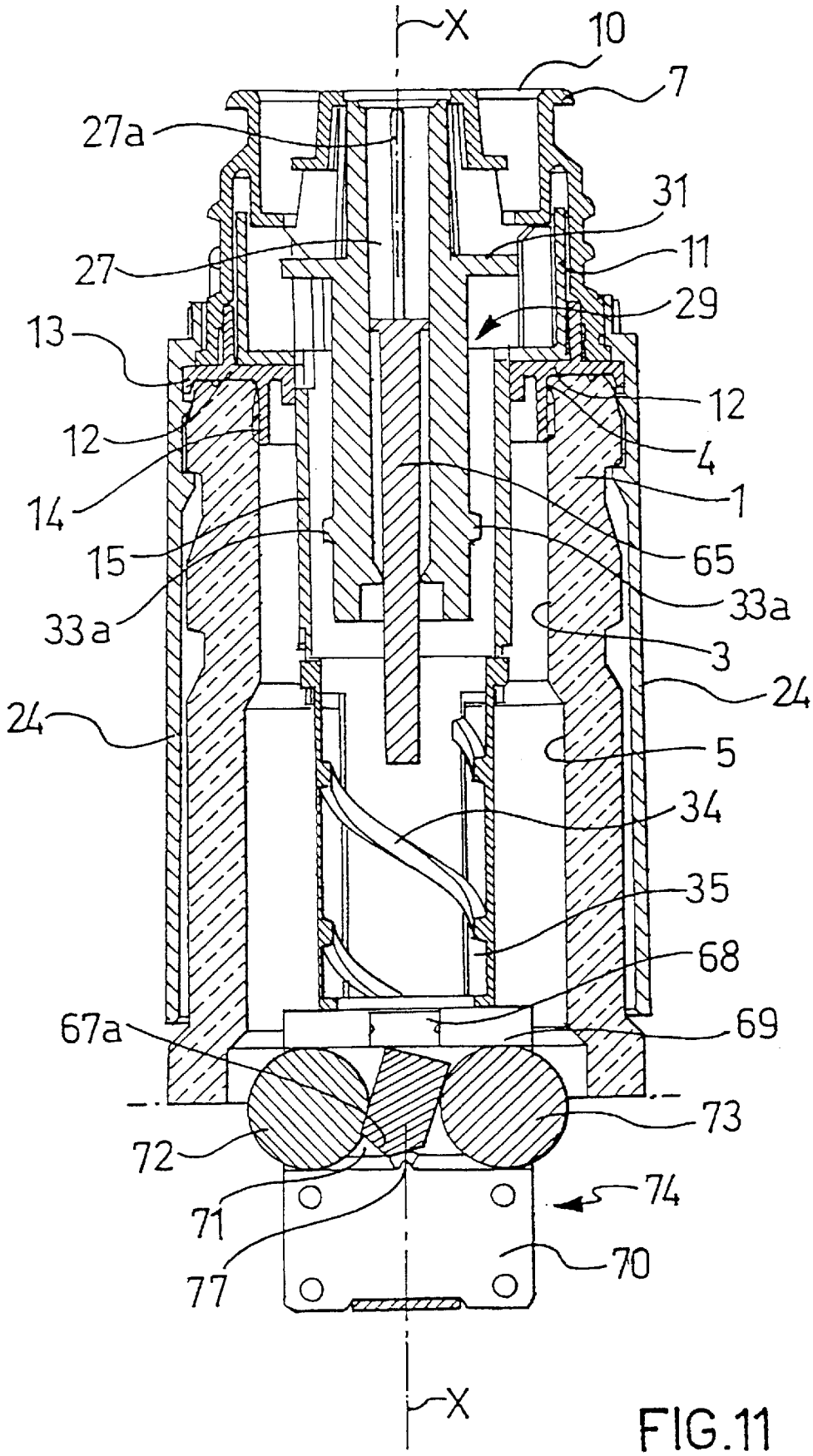
Figure 12:
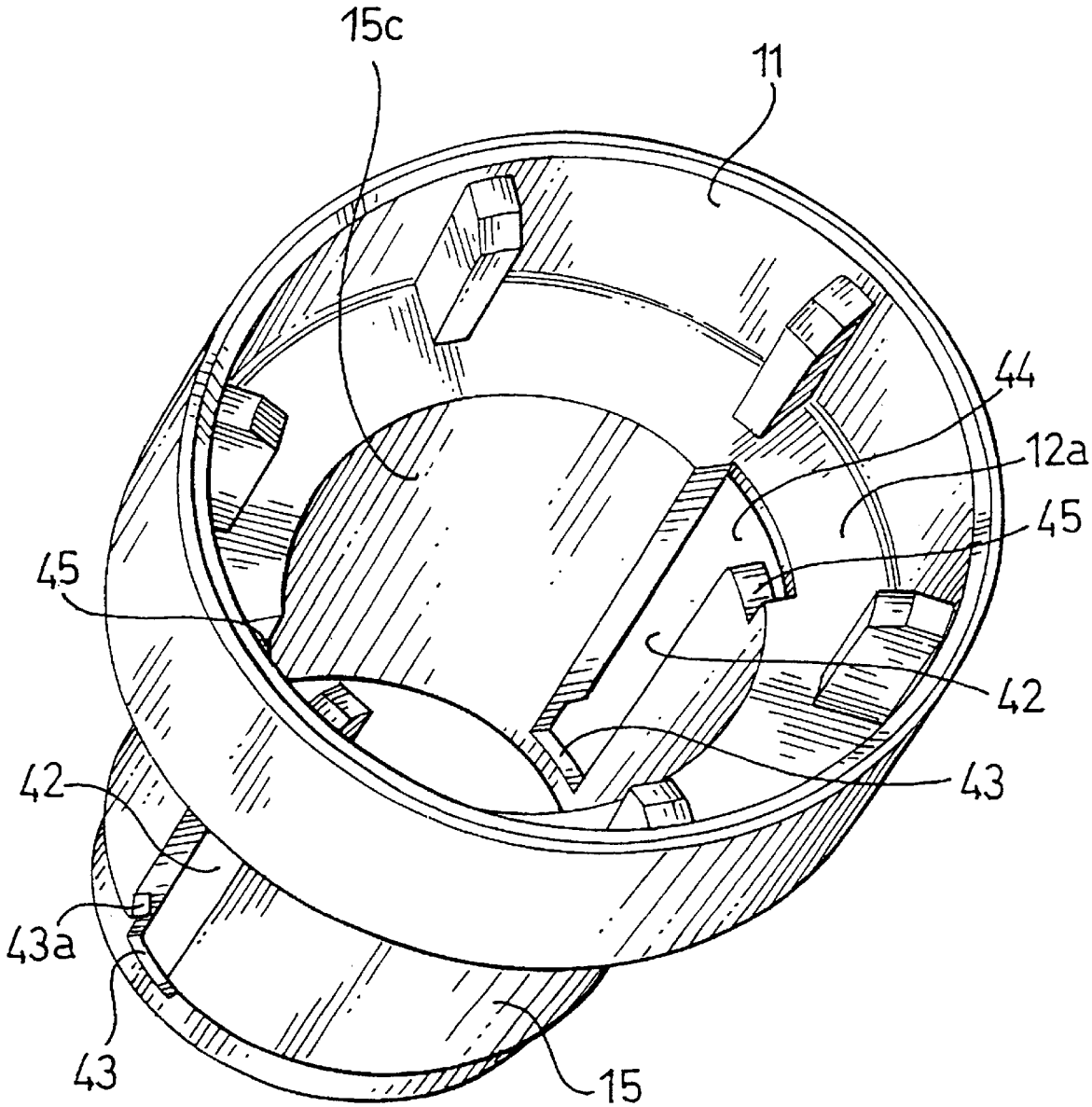
Figure 13:
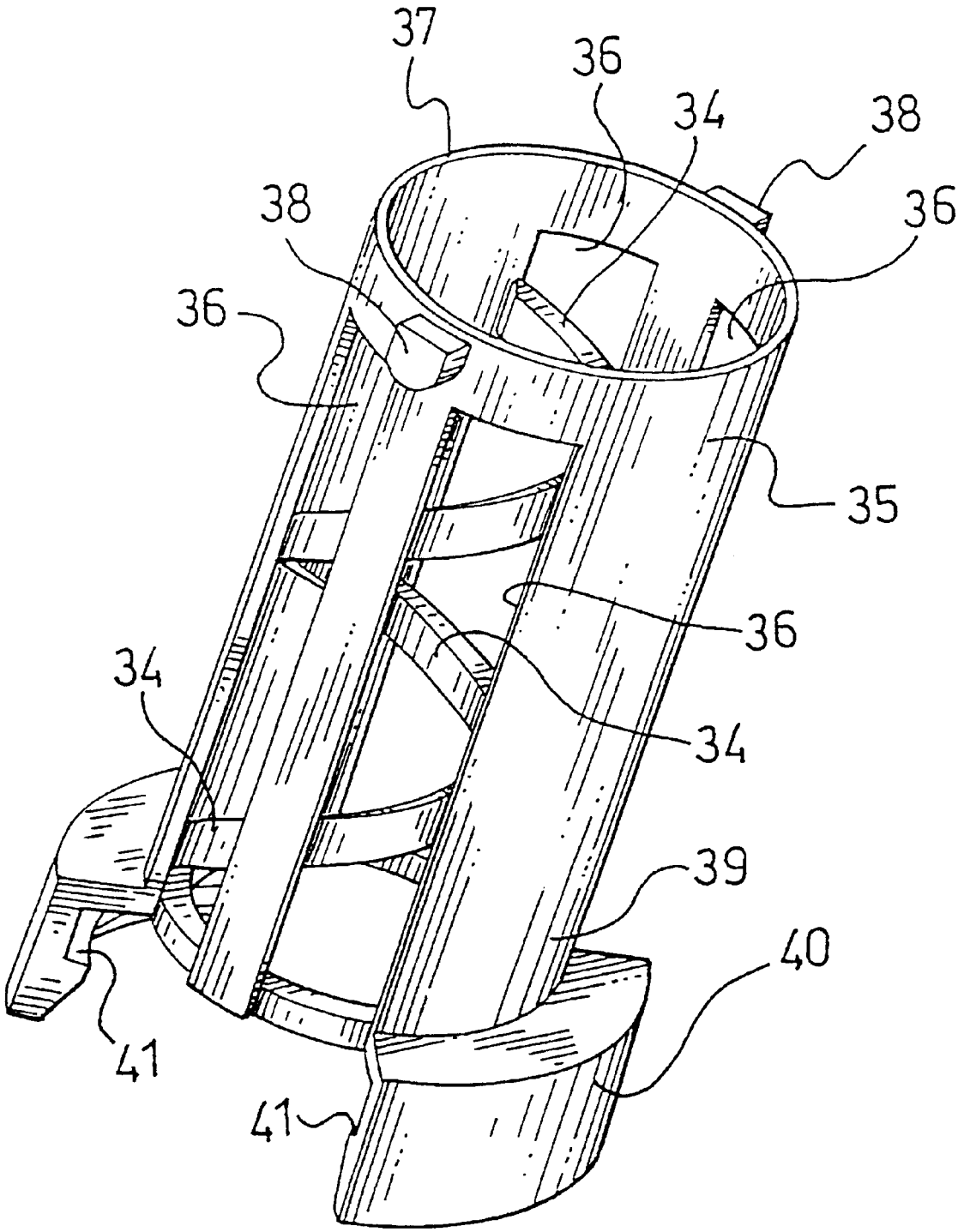
Figure 14:
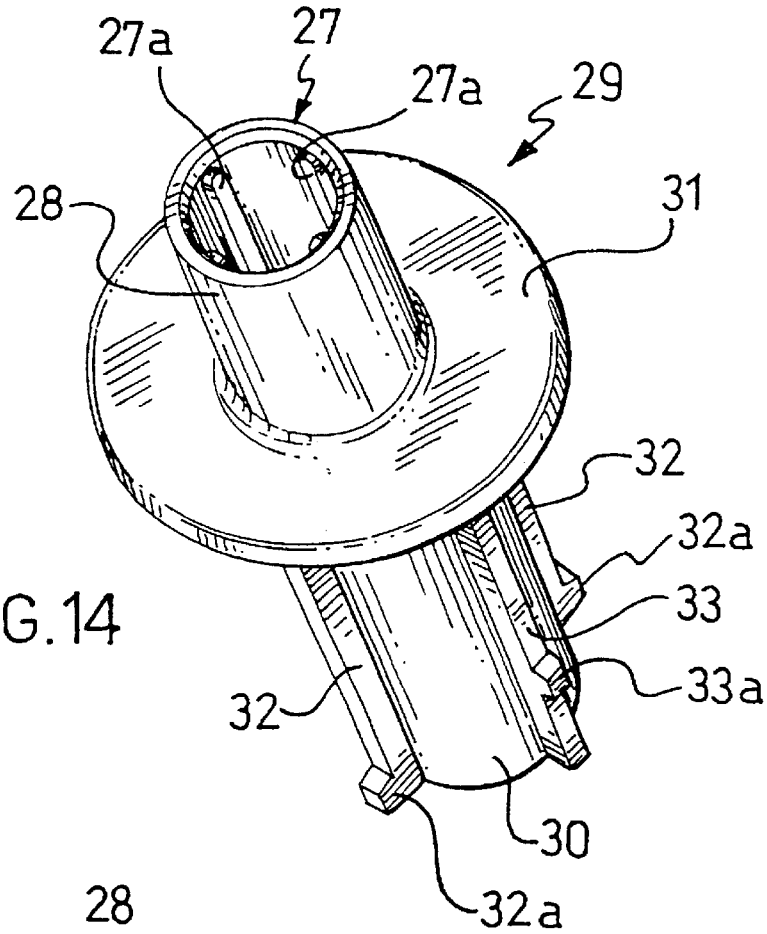
Figure 15:
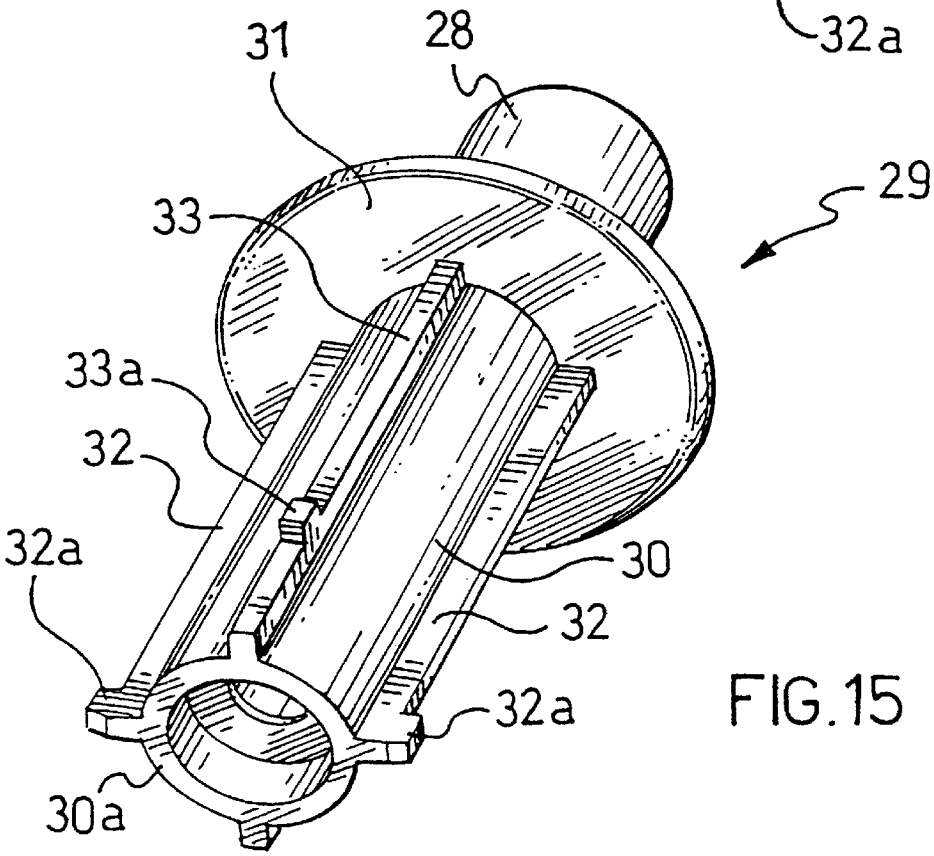
Figure 16:
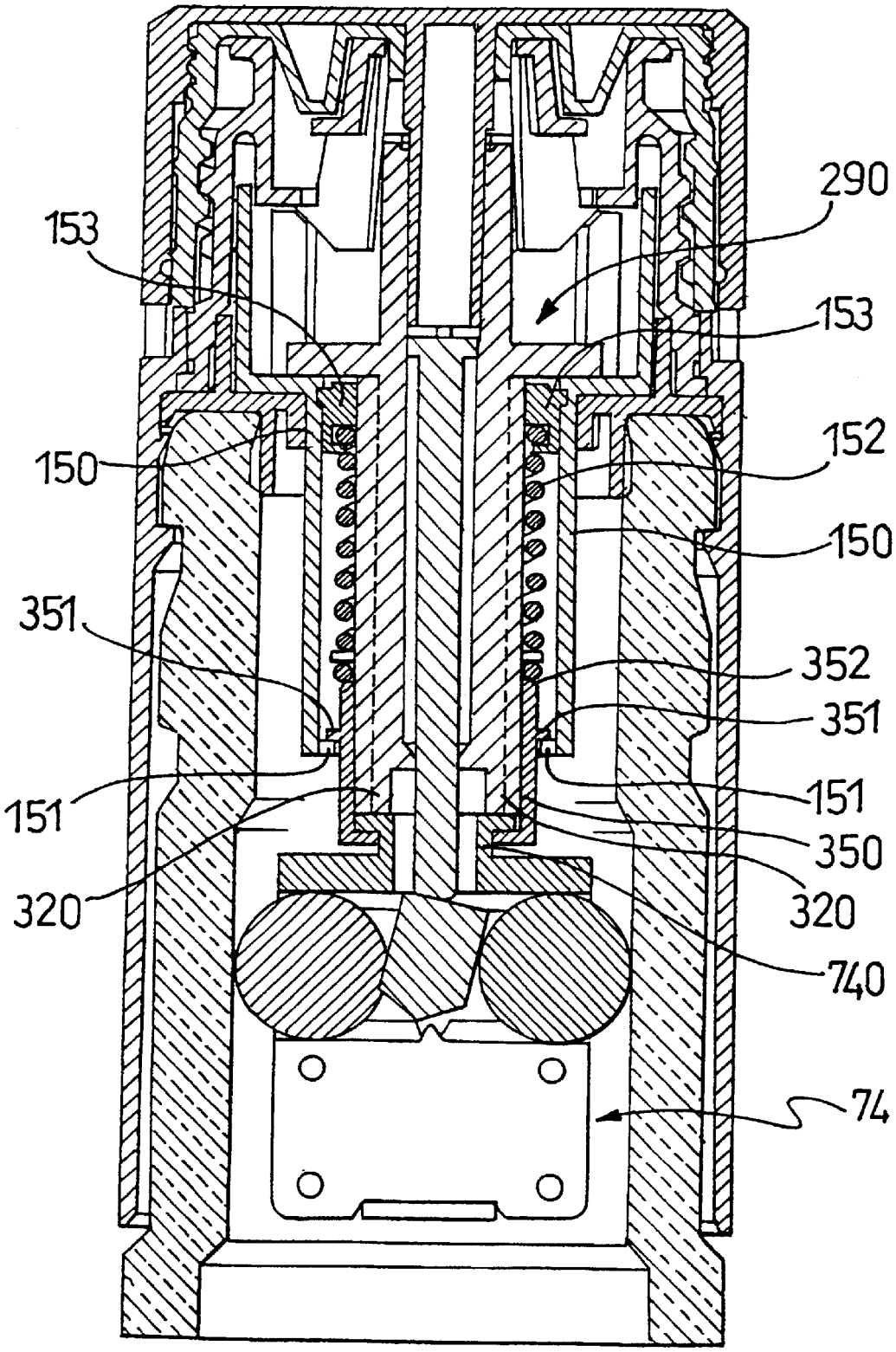
Figure 17:
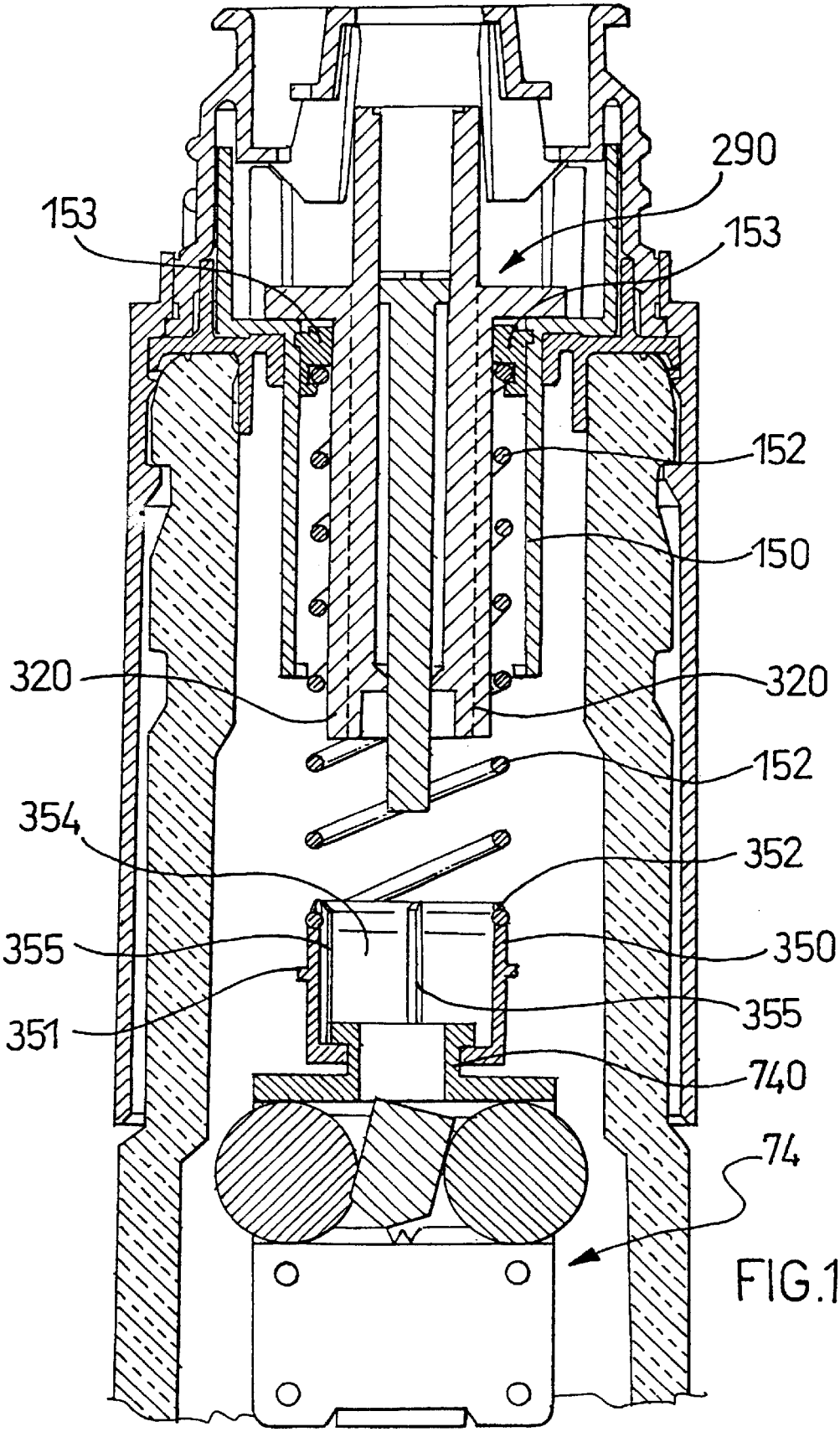
Figure 18:
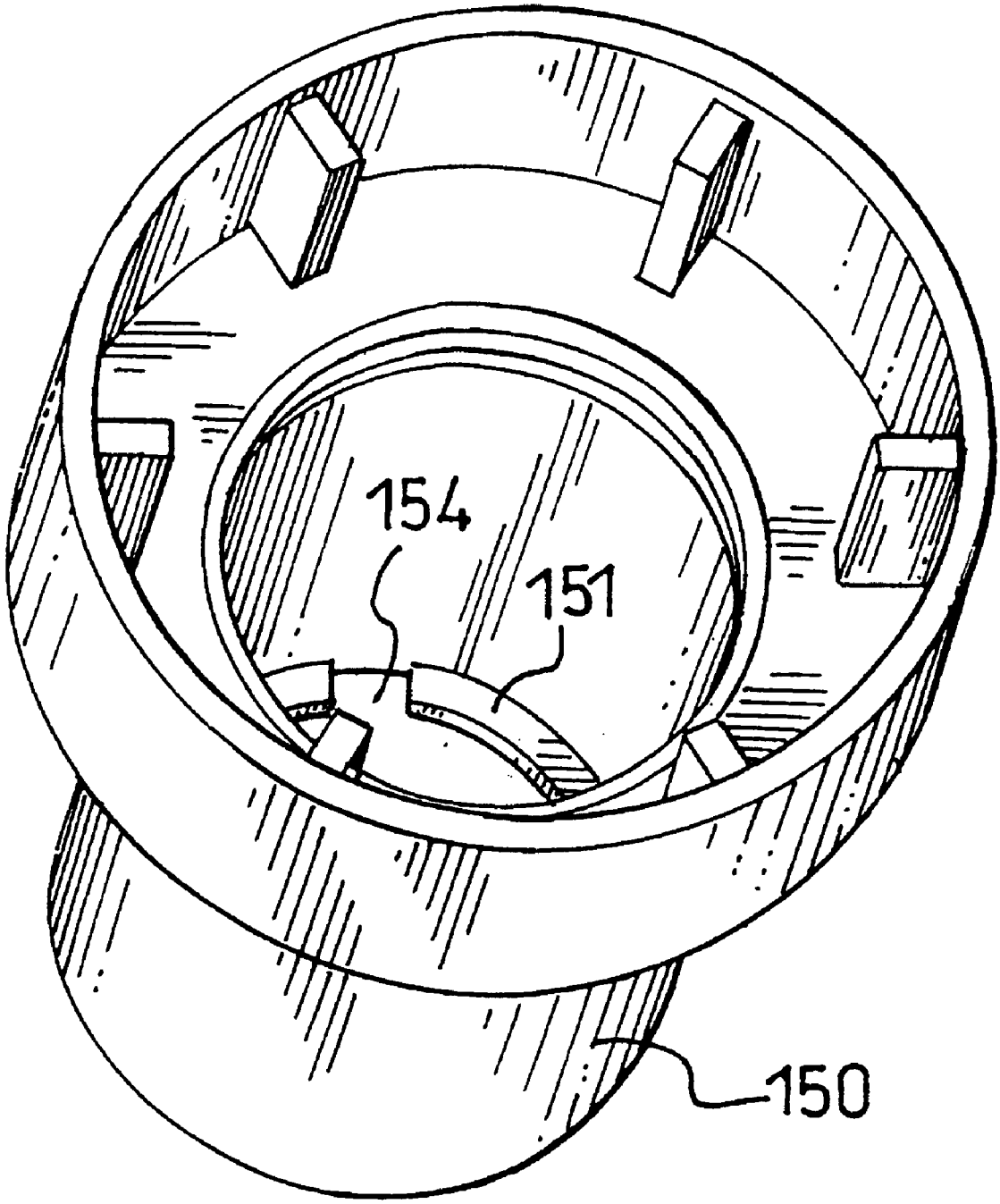
Figure 19:
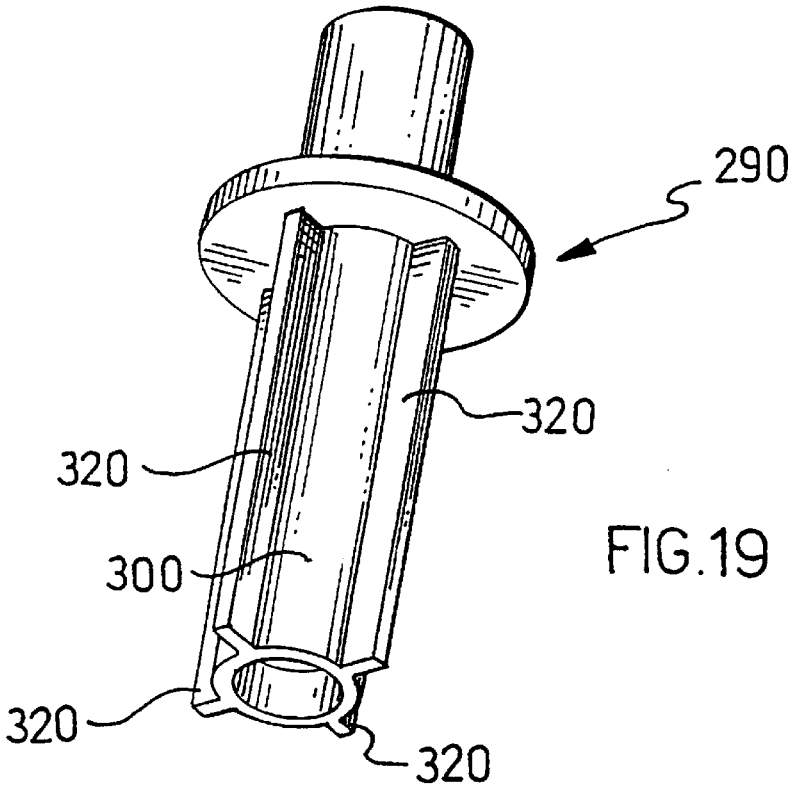
Figure 20:
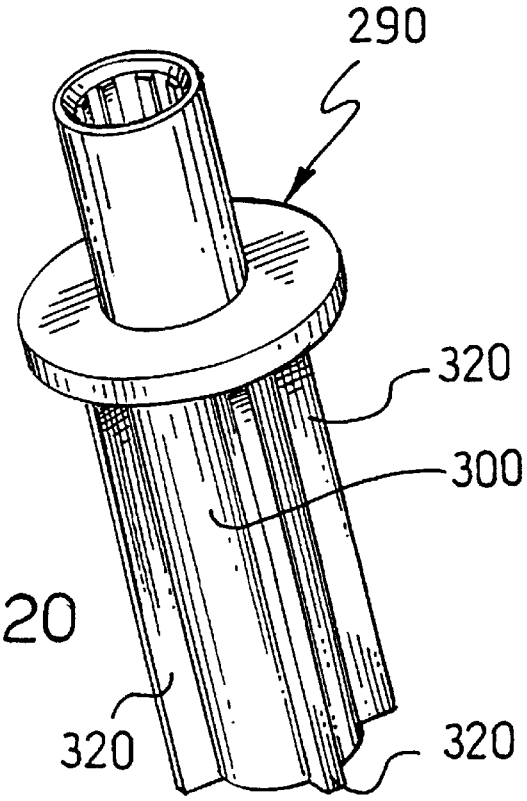
Figure 21:
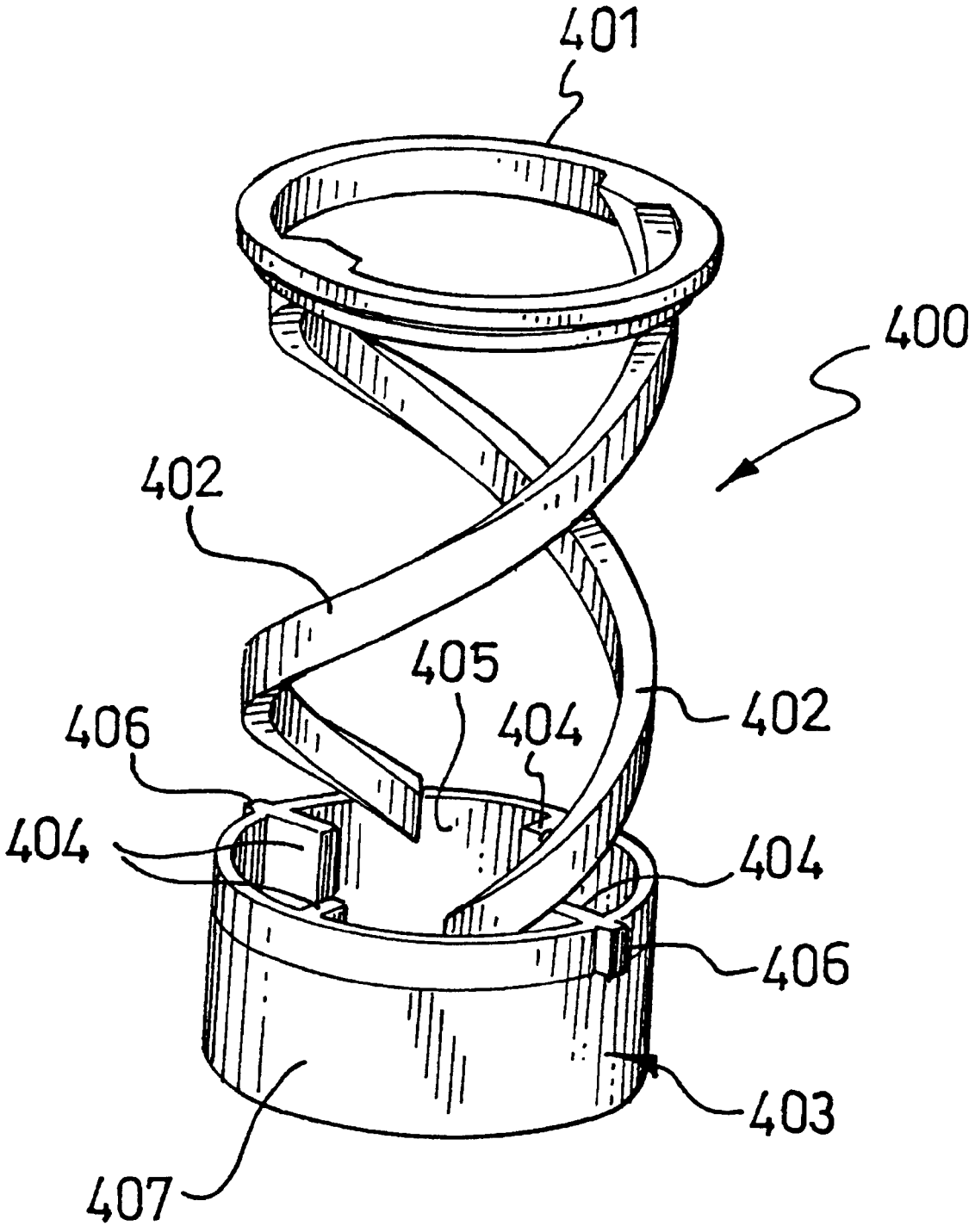

The invention will now be described in greater detail with reference to some practical embodiments thereof, given by way of non-limiting example, and illustrated in the appended drawings, in which:

FIG. 1 is a vertical section showing a first embodiment of a closure according to the invention with the devices for indicating that the initial opening has taken place in the inoperative position, FIG. 2 is a vertical section showing the closure of FIG. 1, taken in a vertical plane offset by 90° from that of FIG. 1, FIG. 3 is a vertical section taken in the same vertical plane as FIG. 1, showing the closure of FIG. 1 with the devices indicating that the initial opening of the container has taken place in the operative position, FIG. 4 is a vertical section showing the closure of FIG. 2, in the position of FIG. 3, taken in a plane offset by 90°, as in FIG. 2, FIG. 5 is a vertical section showing a second embodiment of the closure according to the invention with the devices indicating that the initial opening of the container has taken place in the inoperative position, before the container has been opened, FIG. 6 is a vertical section showing the closure of FIG. 5, taken in a plane offset by 90° from that of FIG. 5, FIG. 7 is a vertical section showing the closure of FIG. 5 with the devices indicating that the initial opening of the container has taken place in the operative position, FIG. 8 is a vertical section showing the closure of FIG. 5, in the position of FIG. 7, taken in a plane offset by 90°, as in FIG. 6, FIG. 9 is a vertical section showing a third embodiment of the closure according to the invention with the devices indicating that the initial opening of the container has taken place in the inoperative position, FIG. 10 is a vertical section taken in the same plane as FIG. 9 with the devices showing that the initial opening of the container has taken place in an intermediate, cocked but not yet operative position, FIG. 11 is a vertical section showing the closure of FIGS. 9 and 10 with the devices indicating that the initial opening of the container has taken place in the operative position, FIG. 12 is a perspective view of the sleeve of the closures of the previous drawings, FIG. 13 is a perspective view of the tubular element of the closures of the previous drawings, FIGS. 14 and 15 are respective perspective views of the connecting element of the closures of the previous drawings, taken from different angles, FIG. 16 is a vertical section showing a fourth embodiment of the closure according to the invention with the devices indicating that the initial opening of the container has taken place, illustrated in an intermediate locked but not yet operative position, FIG. 17 is a vertical section showing the closure of FIG. 16 with the devices indicating that the initial opening of the container has taken place, illustrated in the operative position, FIG. 18 is a perspective view of the sleeve of the closure according to the fourth embodiment of FIGS. 16 and 17, FIGS. 19 and 20 are respective perspective views of the connecting element of the closure according to the fourth embodiment of FIGS. 16 and 17, taken from different angles, FIG. 21 is a perspective view of a tubular helical spring to be used in the closure according to the fourth embodiment of FIGS. 16 and 17.

With reference to the above-mentioned drawings and, in particular, to FIGS. 1 and 2, the neck 1 of a container 2, particularly but not exclusively in the form of a bottle, has a first internal portion 3 adjacent an opening 4 and having a diameter D1, next to which there is a second portion 5 with a diameter D2 larger than D1. A further portion 6 of diameter D3 may be disposed next to the portion 5 on the side nearest the container 2. A pouring body 7 with an internal cavity 8 and ducts 9 which lead to a pouring hole 10 is disposed in the opening 4.

The pouring body 7 is fitted on the first axial tubular portion 11 of a washer 12 which is anchored to the rim of the opening 4 in conventional manner by means of an outer collar 13 and an inner collar 14.

In the embodiment shown in FIG. 1, a sleeve 15 fixed to the washer 12 extends axially inside the neck 1 coaxially with the longitudinal axis X—X thereof.

The characteristics of a preferred embodiment of the sleeve 15 are shown in detail in FIG. 12 and will be described below.

A screw-cap 16 is mounted on the pouring body 7, its thread 17 engaging a thread 18 on the cylindrical outer wall of the pouring body 7.

An outer cap 19 is fitted on and houses the cap 16, restraining it by snap-engagement means shown schematically at 20.

The outer cap 19 has a stem 21 which extends into an axial duct 22 of the pouring body 7, through a central hole 23 in the cap 16.

The rim of the outer cap 19 is connected, in conventional manner, by means of pre-arranged breakage bridges, to the upper edge of a tubular band 24 which covers the outside of the neck 1 of the container, at least in the portions having diameters D1 and D2.

The band 24 is fixed to the neck 1 by means of radial projections 25 which engage in a groove 26 formed in the periphery of the neck.

The stem 21 is engaged axially in a hole 27 of a first tubular portion 28 of a connecting element 29 having a second tubular portion 30 through which the hole 27 extends axially.

The stem 21 is coupled with the internal wall of the hole 27 by conventional coupling means which permit free axial movement whilst being able to transmit angular movements; in practice, these means consist of diametrally-opposed axial grooves 21*a* formed in the outer wall of the stem and engaged by corresponding axial ribs 27*a* projecting from the internal surface of the a hole 27, or vice versa.

In a preferred embodiment, the connecting element 29, which is free to move axially along the axis X—X, also comprises an annular flange 31 which acts as a closure element cooperating with the horizontal surface of the washer 12 which acts as a valve seat, in order to allow liquid to come out of the container through the hole in the pouring 7 but to prevent liquid from being admitted to the container through the pouring hole. As shown in greater detail in FIGS. 14 and 15, the second tubular portion 30 of the connecting element comprises two pairs of diametrally-opposed axial ribs 32 and 33. The ribs 32 have projections 32*a* positioned in the region of the end 30*a* of the portion 30, and the ribs 33 have projections 33*a* positioned in an intermediate region of their axial length between the closure flange 31 and the end 30*a*.

The second axial portion 30 of the connecting element 29 engages, by means of the pair of projections 33*a*, a cylindrical helical thread 34 formed on the internal wall of a tubular element 35 which is shown in greater detail in FIG. 13, and which is positioned so as to be concentric with the second axial portion.

The tubular element 35 also has large windows 36 through which the liquid can flow from the container towards the pouring body, as will be described in detail below.

In the region of the end 37 facing towards the mouth of the container, there are two diametrally-opposed radial projections 38 and, in the region of the opposite end 39, there is a pair of extensions 40 which extend in two peripheral sectors offset by 90° from the diameter on which the projections 38 are formed.

The extensions have larger diameters than the element 35 and have hook-like members 41 projecting radially towards the central axis of the tubular element 35.

The second axial portion 15 of the sleeve, the structural characteristics of which are illustrated in greater detail in FIG. 12, is in a position concentric with the tubular element 35 and with the connecting element 30.

The inner wall 15*c* of the sleeve has a pair of diametrally opposed axial grooves 42 each terminating in a closed base 43 and starting with a hole 44 which extends sideways in a circumferential direction, forming a step 45.

The step 45 of one of the grooves 42 is opposed to the step of the other groove.

In the rest position, after fitting, the projections 38 bear on the steps 45 and can be inserted in the grooves 42 as a result of an angular movement of the tubular element 35 relative to the sleeve 15.

This angular movement is brought about by rotation of the outer cap 19 when the container is first opened, the angular movements being transmitted by means of the stem 21 to the connecting element 29 and by the latter, by means of its portion 30, to the tubular element 35.

After the initial angular movement of the projections 38 out of the steps 45, the engagement between the projections 33*a* of the connecting element 29 and the long-pitch thread 34 also bring about axial movement of the element 35 relative to the sleeve 15 until the projections 38 abut the closed ends 43 of the grooves 42 and are restrained there by projections 43*a*.

In these latter conditions, the tubular element 35 is fully extracted from the sleeve 15, as shown in FIGS. 3, 4, 7, 8 and 11.

With particular reference to FIGS. 1 to 4, it can be seen that an axial extension, generally indicated 46, the side walls of which have indicators which confirm the state of opening of the container, is formed integrally with the end portion 39 of the tubular element 35.

In the rest position, that is, when the container is closed, the axial extension 46 is adjacent the lower end of the sleeve 15 and its inscription is in practice obscured or in any case rendered invisible by the band 24 which surrounds the neck 1 of the container on the outside.

In the operative position, as shown in FIGS. 3 and 4, after the initial opening of the container as a result of the unscrewing of the outer cap 19, the extension 46 is disposed in a position in which it is visible from outside the container, naturally assuming that the container is transparent at least in this region as is the case in most bottles for good-quality alcoholic beverages, providing evidence of opening.

Once the tubular element 35 has come out of the sleeve 15, any rotation imparted to the connecting element 29 in the opposite direction cannot cause the tubular element 35 to go back into the sleeve 15 because the radial projections 33*a* are disengaged from the thread 34 once and for all and the projections 43*a* in any case prevent them from sliding in the opposite direction.

With reference now to FIGS. 5, 6, 7 and 8, which show an embodiment of the present invention which is modified in comparison with that of FIGS. 1 to 4, it can be seen that the sleeve 15 is extended inside the container 2 by a rectangular frame 15*a* closed by a transverse portion 15*b*. In the centre of the transverse element 15*b* there is a rod 47 coaxial with the axis X—X of the container and having a free end 48. A body, generally indicated 49, mounted for sliding in the frame 15*a,* is formed by two plate-shaped elements 49*a* and 49*b* coupled and held together by gluing or welding. The body 49 also has a C-shaped clip which also constitutes a guide for the axial sliding in the frame 15*a* and which may be individualized with writing and/or decorations.

The body 49 is engaged on teeth 41 of the tubular element 35 by means of an annular projection 51 and a groove 52 disposed beneath the annular projection 51.

The body 49 therefore moves axially, together with the tubular element 35, sliding in the frame 15*a*. A housing 53 is formed transversely relative to the axis X—X in the body 49 and spherical bodies 54 and 55 are fitted side by side therein. The housing 53 has openings 56 and 57 facing the inner wall of the neck and having diameters basically slightly smaller than those of the spherical bodies 54, 55 which cannot therefore come out when urged to do so.

The wall 58 which defines the housing 53 on the side facing the container 2 has a through-hole 59 which houses with friction a latch 60 of which an end 61 formed by inclined planes is positioned between the spherical bodies 54, 55, in the region in which they are disposed side by side.

The opposite wall 62, on the other hand, has a cusp 63 projecting towards the housing in the regions in which the spherical bodies are side by side, opposite the end 61 of the latch 60.

This cusp prevents subsequent accidental alignment of the latch 60 with the hole 59 which is coaxial with the rod 47.

As a result, when the container is opened for the first time, the rotation of the connecting element 29, as already described above, brings about axial movement of the tubular element 35 and of the body 49 therewith, along the frame 15*a,* causing the rod 47 to be inserted in the hole 59 and the latch 60 to be thrust between the spherical bodies 54 and 55. The spherical bodies 54 and 55 are thus urged towards the openings 56 and 57 and emerge partially therefrom forming, in the body 49, a transverse dimension larger than that which it had when the spherical bodies were fully inserted in the housing 53, this dimension being permitted by the fact that the body 49 is disposed in a portion of the neck 1 having the diameter D2 which is larger than the diameter D1 of the portion adjacent the mouth.

The mechanism for pushing the spherical bodies 45 and 55 out of the housing 53 is not reversible. Moreover, the body 49 in the position described provides evidence that the initial opening of the container has taken place.

In FIGS. 7 and 8 which show the above-mentioned position, the connecting element 29 is shown in the position in which its closure portion 31 is raised from the valve seat 12*a* which, in this case, is fixed to the sleeves 11 and 15, allowing the liquid to flow out through the pouring body in conventional manner.

In the embodiment shown in FIGS. 5 to 8, it should in fact be noted that the collars 13 and 14 of the washer 12 and the washer itself are formed as an element separate from the sleeves 11 and 15.

With reference to FIGS. 9, 10 and 11, these show a further embodiment of the invention, modified in comparison with that of FIGS. 5, 6, 7 and 8.

As can be seen in FIG. 9, the closure device provides for the outer cap 19 to be fixed to the underlying cap 20 before being fitted on the neck 1, the outer cap 19 being fixed in a first position in which an end portion 19*a* is offset axially relative to the top 20*a* of the cap 20 by a predetermined distance and being restrained in this position by snap-fixing means constituted, for example, by an annular groove 19*b* engaged with a flange 20*b* of the cap.

The stem 21, which engages in the axial hole 27 of the connecting element 29 in the same manner as described with reference to the previous embodiments, is in axial abutment, in the hole 27, with the end 64 of a rod 65 the other end face 66 of which engages a latch 67 housed with friction in a through-hole 68.

The latter is formed in the wall 69 which, together with an opposed wall 70, defines a transverse housing 71 for a pair of spherical bodies 72 and 73 wholly equivalent to the spherical bodies 54 and 55 of the embodiment of FIGS. 5–8.

The housing 71 is formed in a support body, generally indicated 74, functionally equivalent to the body 49 of the embodiment of FIGS. 5–8, and has holes 75 and 76 having diameters basically slightly smaller than those of the spherical bodies 72 and 73.

The latch 67 also has an end having inclined surfaces 67*a* facing towards a cusp 77 carried by the wall 70 of the housing 71 and having the same function as the cusp 63 described above.

The neck 1 of the container has a first portion adjacent the mouth having a diameter D1, a second portion of diameter D2 larger than D1, and a third portion of diameter D3 larger than D1 and D2.

When the closure device is mounted on the neck of the container in order to plug it, an axial thrust is exerted on the outer cap 19, disengaging the annular groove 19*b* from the rib 20*b* until the end portion 19*a* of the outer cap reaches the upper wall of the cap 20. During this movement, the washer 12 is positioned firmly on the rim of the opening of the neck 1 and, at the same time, the stem 21 urges the latch 67 out of the hole 68, by means of the rod 65, wedging the latch 67 between the spherical bodies 72 and 73, causing them to emerge from the housing 71.

This is possible by virtue of the diameter D2 of the neck 1 which is larger than the diameter D1. Although the container is not yet open, the device is already able to provide a first level of security against fraud since, in practice, it cannot be extracted through the neck 1 because it cannot pass through the portion of the neck having the diameter D1 smaller than the diameter D2.

When the container is opened for the first time, as already seen with reference to the embodiment described above, the rotation imparted to the outer cap 19 causes the body 74 with the respective spherical bodies 72 and 73 to be lowered into the neck region of diameter D3, outside the covering of the tubular band 24, showing that the initial opening of the container has taken place.

Preferably, the bodies 49 and 74, as well as the respective latches and spherical bodies, are made of materials which can withstand high temperatures, for example, above 300° C., and are resistant to organic and inorganic acids.

For example, they may be made of glass, ceramics, or fluorinated polymers. The selection of one of the materials indicated above makes it impossible to eliminate the device providing evidence that the initial opening of the container has taken place without destroying or damaging the container, preventing re-use thereof.

With reference to FIGS. 16 and 17, it can be appreciated that the fourth embodiment of the closure differs from the embodiment of FIGS. 10 and 11 by the fact that a tubular element 350 is provided with pairs of diametrically opposed projections 351.

A sleeve 150 is provided with a flange 151. Projections 351 rest on flange 151 under the pressure of a compression coil spring 152 which abuts, at one side, against the upper end 352 of the tubular element 350 and, at the opposite side, against a ring 153 attached to the inner wall of the sleeve 150.

The coil spring 152 is also axially fixed both to the ring 153 and the end 352 of the tubular element 350 in a conventional way.

The body 74 is connected to the bottom end 353 of the tubular element 350 by means of a collar 740.

The inner wall 354 of the tubular element 350 is provided with radially extending axial ribs 355 which, upon rotation of the tubular element 350, engage the axial ribs 320 of a connecting element 290 which is equivalent to the connecting element 29 of the embodiment of FIGS. 10 and 11.

The flange 151 is provided with pairs of diametrically opposed apertures 154 which are spaced around the periphery of the sleeve 150.

As it could be appreciated, upon the rotation of the connecting element 290 the tubular element 350 is angularly displaced. When the projections 351 overlap the apertures 154, they shall snap through them and the tubular element 350 together with the body 74 shall fall into the position illustrated in FIG. 17.

The coil spring 152 allows the angular displacement of the tubular element 350. The same results as those of the embodiments of FIGS. 10 and 11 are consequently obtained.

As an alternative, the coil spring 152, the ring 153 and the tubular element 350 may be manufactured as a single piece 400 shown in FIG. 21.

The piece 400 comprises an upper ring 401 and a coil 402 connecting said ring 401 to a lower tubular element 403.

The tubular element 403 is provided with longitudinal radial ribs 404 which are extending from the inner wall 405 and engage the ribs 320 of the tubular body 300 of the connecting element 290 during the rotation of this latter.

The same tubular element 403 is also provided with radial projections 406 extending from the outer wall 407. Said projections 406 are due to engage the flange 151 of the sleeve 150 and to pass through the apertures 154 upon the angular displacement caused by the element 300.

While the coil spring 152 may be made of a resilient material, such as steel, the piece 400 may be made of a plastic material.

What is claimed is:

1. An anti-fraud closure device for providing evidence of the initial opening of a container (2) for liquids having an opening (4) disposed at the end of a neck (1) extending along a longitudinal axis (X—X) and a duct inside the neck having at least a first portion (5) with a diameter (D2) larger than that (D1) of the portion (3) immediately adjacent the opening (4), the closure device comprising a pouring body (7) which has an internal axial cavity (8) and which is positioned in the opening (4) and projects axially outwards therefrom with a pouring hole (10), a connecting element (29, 290) free to move axially in the cavity (8) of the pouring body (7), fixing means (12) for connecting the pouring body (7) to the neck (1) of the container, and a removable cap (20) on the pouring body (7) for closing and opening the pouring hole (10), an outer cap (19) disposed over and housing the cap (20), an axial stem (21) carried by the outer cap (19) and facing towards the pouring body (7), an axial duct (22) in the pouring body (7), and an axial hole (27) in the connecting element (29, 290) for housing the stem (19) axially when the cap and the outer cap are positioned axially on the pouring body (7) in order to close the hole (10), characterized in that the closure device comprises a sleeve with a first axial portion (11) connected to the pouring body (7) and with a second axial portion (15, 150) extending inside the neck (1) in the first portion (3) thereof, adjacent the opening (4), a tubular element (35, 350) inserted in the second portion (15, 150) of the sleeve and connected thereto, means for partial angular movement and for axial movement of said tubular element between a first position in which the tubular element (35, 350) is inserted in the second portion (15, 150) of the sleeve and a second position in which the tubular element (35, 350) is disposed outside the said portion (15, 150) of the sleeve remaining engaged thereon and inside the portion (5) of the duct of the neck (1) having the diameter (D2) larger than that (D1) of the portion (3) adjacent the opening (4), indicia means (46) for indicating that the initial opening of the container has taken place, the indicia means (46) being carried by the tubular element (35, 350) and being movable therewith inside the neck (1).

2. A device according to claim 1, wherein said means for partial angular movement and for axial movement of said tubular element (35) comprise a threaded portion (34) on the inner surface of said tubular element, a cylindrical body (30) fixed to said connecting element (29) extending axially in the cavity of the tubular element (35), the cylindrical body (30) having at least one radial projection **(33*a*) in engagement with the threaded portion (34), and engagement means (21*a*, 27*a*) between the stem (21) and the axial hole (27) of the connecting element (29)** for transmitting angular movements and permitting axial movements.

3. A device according to claim 1, characterized in that the means for partial angular movement and for axial movement of the tubular element (35) relative to the axial portion (15) of the sleeve are constituted by a pair of diametrally-opposed projections (38) which are formed in the outer surface of the tubular element (35) and are engaged for sliding angularly on a pair of steps (45) extending for a circumferential portion and formed on the inner surface of the axial portion (15) of the sleeve, the projections (38) being engaged for sliding axially in a pair of axial grooves (42) formed in the inner surface of the same axial portion (15) of the sleeve, the grooves (42) being connected to the steps (45) at one end of the circumferential extent thereof and being closed in the region of the end (43) of the sleeve in the neck of the container.

4. A device according to claim 3, characterized in that the end (43) of at least one of the grooves (42) has a projection **(43*a*) interfering with the projection (38) solely in the direction of the axial movement thereof towards the interior of the axial sleeve portion (15)**.

5. A device according to claim 1, wherein said means for partial angular movement and for axial movement of said tubular element (350) comprise pairs of diametrically opposed projections (351) radially extending from said tubular element, a flange (151) circumferentially extending on the inner surface of the axial portion (150) of the sleeve, a pair of apertures (154) on said flange (151), said projections (351) resting on said flange (151), an abutment ring (153) fixed to the inner surface of said sleeve (150), a coil spring between said abutment ring (151) and said tubular element (350) for pressing said projections (351) against said flange and for snapping them through said apertures (154) upon rotation of said connecting element (290).

6. A device according to claim 5, wherein said tubular element (350), said projections (351), said coil spring (152) and said abutment ring (153) are made as a single molded plastic body (400).

7. A device according to claim 1, characterized in that the means for fixing the pouring body (7) to the neck (1) of the container comprise a tubular band (24) which covers the outer surface of the neck (1) for an axial distance at least equal to the portion (3) of the neck adjacent the hole (4), the means (46) for indicating that the initial opening of the container (1) has taken place being covered by the band (24) when the tubular element (35) is inserted in the second sleeve portion (15).

8. A device according to claim 1, characterized in that the means (46) for indicating that the initial opening of the container (1) has taken place is constituted by a body having at least two opposed flat faces.

9. A device according to claim 1, characterized in that the means (46) for indicating that the initial opening of the container has taken place is constituted by a support (49) connected to the tubular element (35) in the region of the end (39) thereof which faces the interior of the neck (1) of the container, the support (49) having a housing (53) with seats for housing at least two spherical bodies (54, 55) disposed side by side on an axis transverse the longitudinal axis (X—X) of the neck (1) of the container, the housing (53) having openings (56, 57) disposed opposite one another on the same transverse axis, the transverse dimensions of the openings (56, 57) being substantially less than the diametral dimensions of the spherical bodies (54, 55), a through-hole (59) in the support (49), coaxial with the axis (X—X) of the neck of the container, open both towards the spherical bodies (54, 55) and towards the base of the container, a latch (60) fitted for sliding with friction in the axial hole (59), one end of the latch (60) facing the spherical bodies (54, 55) in the region in which they are disposed side by side and the other end being in alignment with the free and (48) of a rod (47) also coaxial with axis (X—X) of the neck and projecting from a transverse element (15*b*) of a frame (15*a*) connected to the second axial sleeve portion (15), the rod (47) being housed in the through-hole (59) when the tubular element (35) is in the second position outside the second sleeve portion (15).

10. A device according to claim 9, characterized in that the axial extent of the rod (47), when it is fitted in the through-hole (59) of the support (49), is such as to keep the latch (60) at least partially inserted between the two spherical bodies (54, 55).

11. A device according to claim 9, characterized in that the opposite wall (62) of the housing (53) for the spherical bodies (54, 55) to the wall (58) in which the through-hole (59) opens has a cusp (63) the tip of which faces towards the hole (59).

12. A device according to claim 11, characterized in that the end of the latch (60) which projects towards the spherical bodies (54, 55) faces towards the cusp (63) and has at least one inclined plane (61).

13. A device according to claim 1, characterized in that the outer cap (19) placed over the cap (20) is movable axially relative to the cap (20) between two axially spaced-apart positions and comprises means (19*b*, 20*b*, 19*c*, 20*c*) for fixing it resiliently and releasably to the cap (20) in both positions.

14. A device according to claim 1, characterized in that the means (46) for indicating that the initial opening of the container has taken place comprises a support (74) connected to the tubular element (35) in the region of the end (39) thereof which faces the interior of the container, the support (74) having a housing (71) with seats for housing at least two spherical bodies (72, 73) disposed side by side on an axis transverse the longitudinal axis (X—X) of the neck (1) of the container, the housing (71) being defined by two opposed walls (69, 70) and having openings disposed opposite one another on the axis transverse the axis (X—X) of the neck, the transverse dimensions of the openings being substantially less that the diametral dimensions of the spherical bodies (72, 72), a through-hole (68) formed in the wall (69) of the housing (71) facing the tubular element (35), coaxial with the axis (X—X) of the neck (1) in alignment with the stem (21), a latch (67) fitted for sliding with friction in the through-hole (68), the latch (67) being in contact, at one end, with the end of the stem (21) and, at the other end, with the spherical bodies (72, 73) above the region in which they are disposed side by side.

15. A device according to claim 14, characterized in that the latch (67) is in contact with the stem (21) with the axial interposition of a rod (65) housed in the axial hole (27) in the connecting element (29).

16. A device according to claim 14, characterized in that the distance between the two positions between which the outer cap (19) is movable axially relative to the cap (20) is substantially equal to the axial distance which the latch (67) has to travel in order to come out of the hole (68) and to be inserted between the two spherical bodies (72, 73).

17. A device according to claim 14, characterized in that the wall (70) defining the housing (71) of the spherical bodies (72, 73) opposite the through-hole (68) housing the latch (67) has a cusp-shaped projection (77) the tip of which faces the hole (68).

18. A device according to claim 14, characterized in that the latch (67) has at least one inclined plane in its end (67*a*) which faces the spherical bodies (72, 73).

19. A device according to claim 1, characterized in that the connecting element (29) has a closure element (31) for opening and closing the duct (9) in the pouring member (7) in order to allow the liquid to flow out of the container and to prevent admission of the liquid from outside, respectively.

* * * * *